United States Patent [19]

Weller et al.

[11] Patent Number: 4,549,730

[45] Date of Patent: Oct. 29, 1985

[54] SIGNATURE MACHINES

[75] Inventors: Ronald W. Weller, Orland Park; Terrence H. Drope, Downers Grove, both of Ill.

[73] Assignee: McCain Manufacturing Corporation, Chicago, Ill.

[21] Appl. No.: 545,218

[22] Filed: Oct. 26, 1983

[51] Int. Cl.[4] ..... B65H 3/08

[52] U.S. Cl. ..... 271/100; 271/104; 271/166

[58] Field of Search ..... 271/99, 100, 101, 102, 271/108, 104, 166, 136, 118, 303

[56] References Cited

U.S. PATENT DOCUMENTS

| | | | |
|---|---|---|---|
| 3,008,707 | 12/1961 | McGarvey | 271/303 |
| 3,658,319 | 4/1972 | Glaser | 271/100 |
| 3,874,650 | 4/1975 | Steigerwald et al. | 271/118 |
| 3,904,190 | 9/1975 | Kuehn | 271/108 |
| 3,921,523 | 11/1975 | Jähne | 271/99 |

*Primary Examiner*—Duane A. Reger
*Assistant Examiner*—Alvin Oberley
*Attorney, Agent, or Firm*—Kinzer, Plyer, Dorn & McEachran

[57] ABSTRACT

A signature feeding machine in which signatures are fed one by one from a stack in a supply hopper by suction devices; when a signature is not to be fed the stack is displaced so that the suction devices are inoperable to effect feeding and preferably suction is discontinued at the same time.

2 Claims, 3 Drawing Figures

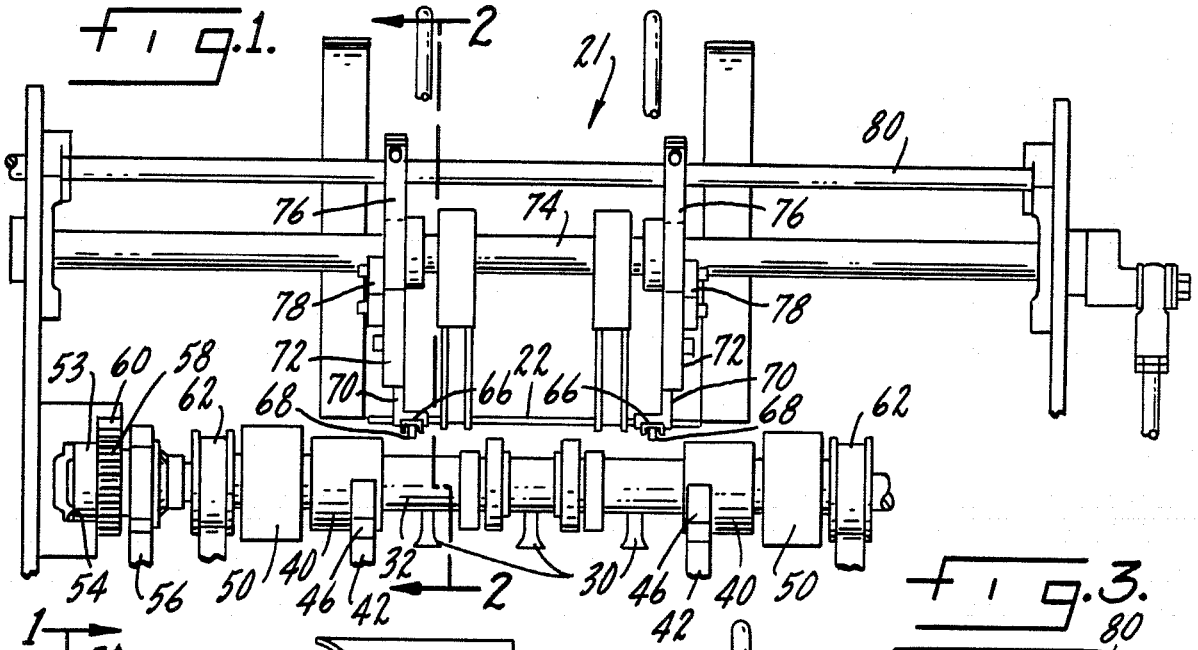
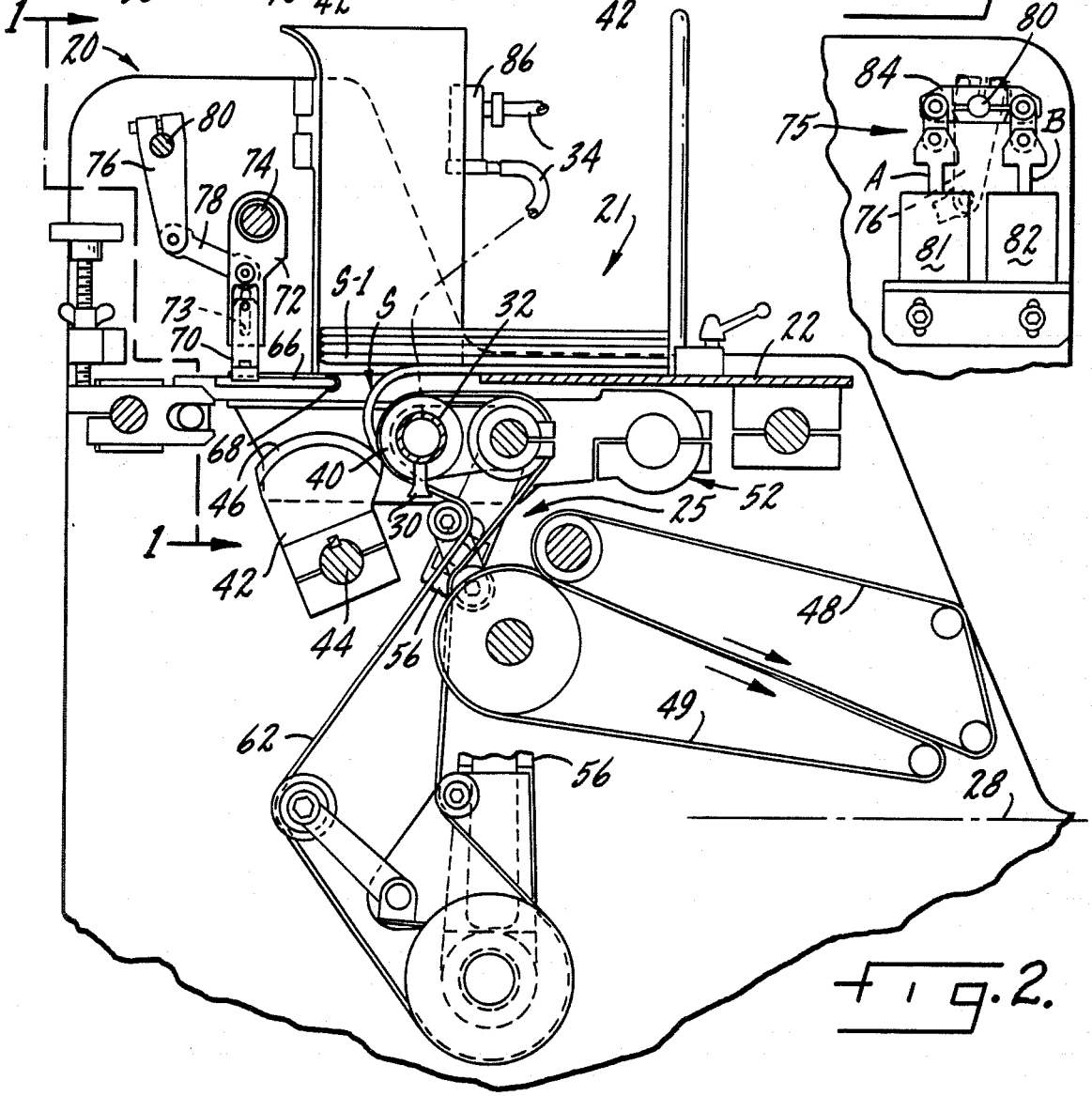
Fig. 2.

SIGNATURE MACHINES

This invention relates to cyclically operable machines for feeding printed signatures, sheets and other printed matter such as magazines from a stack, eventually to arrive on a conveyor.

Magazines and books are a collection of signatures. In its simplest form, a signature is simply a folded sheet of printed matter. The same machine may be used to feed unfolded or single page inserts. In the instance of a magazine, demographically varied, signatures or inserts may or may not be fed from the hopper in which they are stacked, depending upon the demographic selection or arrangement by the publisher.

In most instances the signature to be fed to the conveyor, there to be collected along with other signatures, or even in the instance of an entire magazine in the hopper, the endmost (usually the bottommost) printed material is captured by one or more suction grippers which advance the signature to a feeder which in turn feeds the conveyor.

In a cycle in which a signature is not to be fed, because it is not to be part of the magazine (or in an instance where an entire magazine is not to be fed) disabling the suction to prevent feeding has been found to be disadvantageous particularly where the nonfeed circumstances is repeated in successive cycles. What happens is the suction cups rub the stack and disorient it. The primary object of the present invention is to overcome this problem and to prevent feeding in repeated cycles without necessarily disturbing continued oscillation of the suction cups and continued oscillation of related features employed to advance the signature to the conveyor.

In normal operation, where the suction cups are effective to withdraw the signature there is nonetheless, in the known machine, a mechanical timing valve which interrupts the suction at the appropriate time so that the signature is released to the means (usually opposed rollered or tapes) which advance the signature to the conveyor. Under the present invention, even though the stack is displaced from the suction cups when a signature is not to be fed, nonetheless there is a chance of an inadvertent capture if the normal suction cycle is allowed to prevail. Accordingly, a further object of the present invention is to disable the supply of suction concurrently with lifting or otherwise displacing the stack so there is double assurance of the desired nonfeed circumstance.

IN THE DRAWING

FIG. 1 is a rear view of a machine, under the present invention, substantially on the line 1—1 of FIG. 2;

FIG. 2 is a sectional view of the machine shown in FIG. 1;

FIG. 3 is a detail view of a solenoid assembly.

The machine 20, FIG. 2, is a signature feeder but may also be used for cyclically feeding, one by one, magazines or individual sheets stacked in a supply hopper 21 having a bottom support plate 22. The endmost (bottommost) signature S is to be withdrawn from the supply hopper and advanced into a feeder means 25 which in turn feeds the withdrawn signature (or other piece of printed matter) to a conveyor belt 28. To achieve this, a plurality of suction cups 30 are mounted on a hollow shaft 32 to which vacuum is communicated through a hose 34. This constitutes a known arrangement, and a mechanical valve (not shown) is timed to communicate vacuum when needed and to discontinue it when no longer needed, as will be explained.

The shaft 32 which carries the suction cups 30 is so positioned that when a signature is to be withdrawn the suction cups have a tangential path in contact with the bottommost signature and at this time are effective, by virtue of the vacuum communicated thereto, to grab and hold, in effect, the back of the bottommost signature. As will also be explained in more detail, the suction cups are then rotated effectively to pull the signature down, and a carriage on which the shaft 32 is mounted is translated horizontally in a forward direction so that the withdrawn signature is both inverted and fed to the feeder mechanism which in turn feeds the conveyor 28 as can be seen in FIG. 2.

The feeder mechanism is also known and comprises a plurality of idler rollers 40 positioned adjacent the suction cups on the shaft 32. Opposed to the rollers 40 are constantly rotating segment discs 42 secured to a constantly rotating shaft 44. The segment discs 42 have thick rubber shoes 46 which at the appropriate time are rotated into opposition to the rollers 40 so that the signature, being held by suction, becomes clamped between the rollers 40 and the feeder shoes 46 constituting an effective bite for forcing the signature further in the direction of the conveyor 28. Suction may now be discontinued and in the known machine is discontinued by the mechanical valving device, not shown, but referred to above.

The signature which is clamped between the rollers 40 and the opposing rubber shoes 46 is forced into a continuation of the feeder mechanism represented by opposed feed belts 48 and 49 which are effective to drive the signature forwardly onto the conveyor 28, completing functions with which the present disclosure is introduced.

In the known machine the shaft 32 which carries the suction cups 30 is journaled for rotation in a pair of side plates as 50 comprising part of a carriage 52 having end stubs and idler rollers as 53 riding in guides 54, constraining the carriage assembly for reciprocal motion in a horizontal path beneath the supply hopper. The carriage in turn is reciprocated back and forth by an arm 56 which is rocked or oscillated by an eccentric, not shown.

The shaft 32 carries a pinion 58, FIG. 1, engageable with a fixed rack 60 by which shaft 32 is rocked, concurrently with horizontal motion of the carriage 52. In FIG. 2, carriage 52 is shown part way through its movement to the right along its horizontal path. The suction cups 30 have already carried signature S into the bite of the rollers 40 and the opposed segment shoes 46 so that the latter will forcefully deliver the signature into the bite of the belts 48, 49. Vacuum to the suction cups has been valved off since the signature is under control of the feeder means 25. Vacuum will not be delivered to the cups 30 until gear 58 (engaged with rack 60) on movement of the carriage 52 back to the left, has rotated shaft 32 to the point where the cups 30 are tangent to the underside of the next signature S-1 to be withdrawn.

Timing belts 62 constantly rotate the rollers 40.

To displace the signature stack so that the suction cups will not disturb the pile, especially in repeated, successive cycles when a signature is not to be fed (say signature S-1 and the next two above it) means are provided under the present invention to interdict action of the suction cups.

Such displacement, in the form of the machine shown, amounts to lifting the stack itself by a pair of lifter fingers 66 having rollers 68 at their free, innermost, forward ends. Each finger 66 is rigidly secured to the lower end of a bracket 70, FIG. 2, secured for vertical adjustment (screw and slot) on an operating arm 72 which has the slot (73) for adjustment.

Arm 72 is rotatably mounted on a fixed support shaft 74 and it can be seen that by swinging the arm 72 the corresponding finger roller 68 will travel on an arc, such that if the counterclockwise swing, FIG. 2, be sufficient, finger 66 and its roller will travel on an ascending arc, lifting the stack of signatures by a fraction of an inch sufficient to displace the stack from contact by the suction cups.

Swinging of the arm 72 on shaft 74 may be accomplished in an accurately timed manner in many different ways but we prefer a prompt, fast, forceful action achieved by a double-acting solenoid arrangement 75, FIG. 3.

To this end each arm 72 is under control of a lever 76 joined to the arm 72 by a related link 78. Each lever 76 is clamped rigidly to a rock shaft 80.

In normal operation, one of the solenoids remains energized as long as signatures are to be fed, in successive cycles. When a signature is not to be fed, that solenoid is deenergized and the other one is energized, so that of their respective armatures A and B one will be raised and one lowered, simultaneously, assuring swift, positive and forceful rocking of a center-pivoted lever 84 to which the upper ends of the armatures are linked as shown in FIG. 3. Shaft 80, concurrently is rocked and so are the two levers 76 clamped thereto, causing the stack of signatures to be lifted so that action by the suction cups is interdicted. When the current which energized the solenoids is discontinued, the usual solenoid return springs restore the armatures A and B.

Current for thus producing stack displacement is a programmed matter, programmed to occur when a signature is not to be delivered. Also, there is a solenoid valve 86, FIG. 2, interposed in the hose 34 and this valve is actuated concurrently with solenoids 81 and 82 so that delivery of vacuum is discontinued to the inside of shaft 32 communicating with the suction cups.

What is claimed is:

1. In a cyclically operable machine for feeding printed signatures one by one in successive cycles from a hopper where the signatures repose on one another in a horizontal attitude, in which feeding of the signatures is accomplished by a rotary suction gripper having a path of effective tangential contact with the signature to be fed, capturing and withdrawing that signature from the stack by suction and delivering it to a feeder synchronized to the suction gripper cycles: a plurality of spaced fingers each carried by a respective operating arm, each arm being pivotally mounted on and dependent from a support shaft, a rock shaft adjacent and parallel to said support shaft, said rock shaft having a plurality of levers rigidly clamped thereto, a link joining each lever to a respective arm so that when the rock shaft is oscillated in one direction the arms and their fingers move in an arc to lift the signature stack and displace it from the path of the suction gripper, a pair of solenoids having their armatures connected in a double-acting relation to a center pivoted lever clamped to said rock shaft, one solenoid being in an energized state and the other solenoid being in a deenergized state to hold the rock shaft stationary and dispose the fingers free of the signature stack so long as signatures are to be fed cyclically one by one, whereby upon reversing the states of the solenoids the rock shaft is oscillated in said one direction to cause the fingers to lift the signature stack when a signature is not to be fed.

2. In a cyclically operable machine for feeding printed signatures one by one in successive cycles from a hopper where the signatures repose on one another in a horizontal attitude, in which feeding of the signatures is accomplished by a rotary suction gripper having a path of effective tangential contact with the signature to be fed, capturing and withdrawing that signature from the stack by suction and delivering it to a feeder synchronized to the suction gripper cycles: a rock shaft having a plurality of operating levers rigidly clamped thereto and means connecting a plurality of lift fingers to the respective levers, said lift fingers being positioned beneath the signature stack and so disposed that when the rock shaft is oscillated in one direction the fingers move in an ascending arc to lift the signature stack and displace it from the path of the suction gripper, a pair of solenoids having their armatures connected in a double-acting relation to a center pivoted lever clamped to said rock shaft, one solenoid being in an energized state and the other solenoid being in a deenergized state normally to hold the rock shaft stationary and dispose the fingers free of the signature stack so long as signatures are to be fed cyclically one by one by the action of the suction gripper, whereby upon reversing the states of the solenoids the rock shaft is oscillated in said one direction along with said operating levers to cause the fingers to lift the signature stack away from said path of tangential contact when a signature is not to be fed.

* * * * *